US011551902B2

(12) United States Patent
Shinkawa et al.

(10) Patent No.: US 11,551,902 B2
(45) Date of Patent: Jan. 10, 2023

(54) ELECTRON EMITTING ELEMENT

(71) Applicant: SHARP KABUSHIKI KAISHA, Sakai (JP)

(72) Inventors: Kohji Shinkawa, Sakai (JP); Tadashi Iwamatsu, Sakai (JP); Tomohiro Kosaka, Sakai (JP); Kazuya Tsujino, Sakai (JP); Reshan Maduka Abeysinghe, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 14 days.

(21) Appl. No.: 17/367,523

(22) Filed: Jul. 5, 2021

(65) Prior Publication Data

US 2022/0020554 A1 Jan. 20, 2022

(30) Foreign Application Priority Data

Jul. 15, 2020 (JP) ..... JP2020-121456

(51) Int. Cl.
*H01J 1/312* (2006.01)
*H01J 29/96* (2006.01)

(52) U.S. Cl.
CPC ..... *H01J 29/96* (2013.01); *H01J 1/312* (2013.01); *H01J 2201/3125* (2013.01); *H01J 2201/3195* (2013.01)

(58) Field of Classification Search
CPC ..... H01J 1/313; H01J 2329/0407–0478; H01J 2201/3125; H01J 2201/3195
See application file for complete search history.

(56) References Cited

U.S. PATENT DOCUMENTS

2019/0157033 A1* 5/2019 Adachi ..... H01J 1/312
2019/0302055 A1 10/2019 Komaru et al.
2021/0175039 A1* 6/2021 Shinkawa ..... H01J 1/30

FOREIGN PATENT DOCUMENTS

JP 2016-136485 A 7/2016
JP 2019-186190 A 10/2019
JP 2021150246 A * 9/2021
WO WO-2009046238 A1 * 4/2009 ..... H01J 29/86

* cited by examiner

*Primary Examiner* — Mariceli Santiago
(74) *Attorney, Agent, or Firm* — ScienBiziP, P.C.

(57) ABSTRACT

This electron emitting element includes a lower electrode, a surface electrode facing the lower electrode, a resistance layer arranged between the lower electrode and the surface electrode, and an insulating layer arranged between the lower electrode and the surface electrode. The resistance layer is an insulating resin layer containing conductive fine particles in a dispersed state. The insulating layer has a peripheral region for defining the electron emission region, and an emission control region which is arranged so as to overlap the electron emission region defined by the peripheral region. The emission control region is configured by a line-shaped insulating layer, a plurality of dot-shaped insulating layers, or both a line-shaped insulating layer and a plurality of dot-shaped insulating layers. The percentage of an area that the emission control region represents within an area of an electron emission region defined by the peripheral region is 2% or more and 60% or less.

11 Claims, 8 Drawing Sheets

ELECTRON EMITTING ELEMENT

BACKGROUND OF THE INVENTION

Field of the Invention

The present invention relates to an electron emitting element.

Description of the Background Art

An electron emitting element is known in which a resistance layer is provided between an electrode substrate and a surface electrode (for example, see Japanese Unexamined Patent Application Publication No. 2016-136485). A silicone resin layer containing silver nanoparticles is used as the resistance layer.

In this electron emitting element, a current flows through the resistance layer due to an electric field generated by applying a voltage between the two electrodes. At this time, some of the electrons pass through the surface electrode and are emitted into the atmosphere and the like. Such an electron emitting element may be used as a charging device that charges a photosensitive body, a light emitting device, and the like.

However, in the conventional electron emitting element, the silver nanoparticles can sometimes aggregate inside the resistance layer to form agglomerates. These agglomerates become current leakage paths inside the element, and may cause sudden interruptions in the function of the electron emitting element, or may lead to a reduction in the life of the electron emitting element.

The present invention has been made in view of such circumstances, and provides an electron emitting element having excellent electron emission characteristics and excellent life characteristics.

SUMMARY OF THE INVENTION

The present invention provides an electron emitting element including: a lower electrode; a surface electrode facing the lower electrode; a resistance layer arranged between the lower electrode and the surface electrode; and an insulating layer arranged between the lower electrode and the surface electrode; wherein the resistance layer is an insulating resin layer containing conductive fine particles in a dispersed state, the lower electrode, the resistance layer, and the surface electrode are provided such that electrons flow to the resistance layer as a result of a potential difference being generated between the lower electrode and the surface electrode, to cause electrons to be emitted from an electron emission region of the surface electrode, the insulating layer has a peripheral region for defining the electron emission region, and an emission control region which is arranged so as to overlap the electron emission region defined by the peripheral region, the emission control region is configured by a line-shaped insulating layer, or is configured by a plurality of dot-shaped insulating layers, or is configured by both a line-shaped insulating layer and a plurality of dot-shaped insulating layers, and a percentage of an area that the emission control region represents within an area of an electron emission region defined by the peripheral region is 2% or more and 60% or less.

The conductive fine particles in the resistance layer have a tendency to accumulate at the edges of the insulating layer (the interface between the resistance layer and the insulating layer). In addition, electron emission points are formed at the locations where the conductive fine particles have accumulated. Therefore, by forming a line-shaped or dot-shaped insulating layer (emission control region) so as to overlap the electron emission region, a large number of electron emission points can be formed in the electron emission region. Consequently, the electron emission characteristics of the electron emitting element can be improved. Furthermore, the amount of conductive fine particles that accumulate at a single electron emission point can be reduced. Therefore, the formation of current leakage paths inside the element can be suppressed. As a result, the life of the electron emitting element can be extended.

DESCRIPTION OF THE PREFERRED EMBODIMENTS

Figure 1:
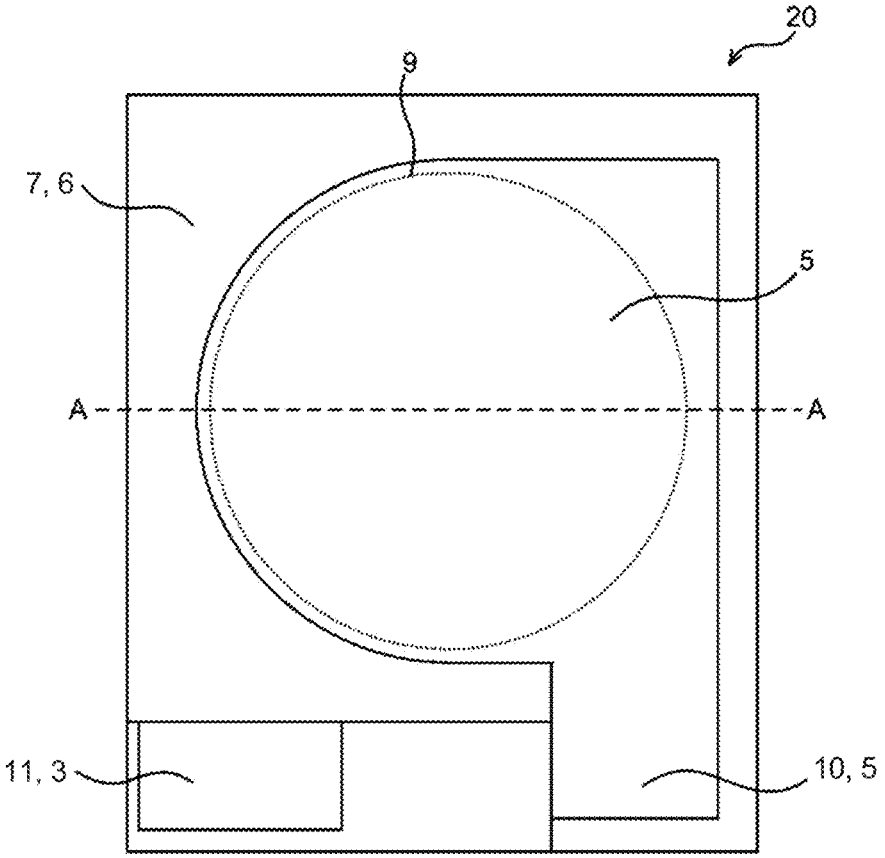
FIG. 1 is a schematic plan view of an electron emitting element according to an embodiment of the present invention.

The electron emitting element of the present invention includes: a lower electrode; a surface electrode facing the lower electrode; a resistance layer arranged between the lower electrode and the surface electrode; and an insulating layer arranged between the lower electrode and the surface electrode; wherein the resistance layer is an insulating resin layer containing conductive fine particles in a dispersed state, the lower electrode, the resistance layer, and the surface electrode are provided such that electrons flow to the resistance layer as a result of a potential difference being generated between the lower electrode and the surface electrode, to cause electrons to be emitted from an electron emission region of the surface electrode, the insulating layer has a peripheral region for defining the electron emission region, and an emission control region which is arranged so as to overlap the electron emission region defined by the peripheral region, the emission control region is configured by a line-shaped insulating layer, or is configured by a plurality of dot-shaped insulating layers, or is configured by both a line-shaped insulating layer and a plurality of dot-shaped insulating layers, and a percentage of an area that the emission control region represents within an area of an electron emission region defined by the peripheral region is 2% or more and 60% or less.

The total edge length of the emission control region within a unit area of an electron emission region defined by the peripheral region is preferably 90 cm/cm$^2$ or more and 5,000 cm/cm$^2$ or less. As a result, a large number of electron emission points can be formed in the electron emission region, and the electron emitting element can be provided with both excellent electron emission characteristics and excellent life characteristics.

The line width of the line-shaped insulating layer or the size of the dot-shaped insulating layer is preferably 1 μm or more and 10 μm or less. As a result, a large number of electron emission points can be formed in the electron emission region, and the electron emitting element can be provided with both excellent electron emission characteristics and excellent life characteristics.

The emission control region is preferably evenly distributed in an electron emission region defined by the peripheral region. As a result, a large number of electron emission points can be evenly formed in the electron emission region, and the electron emitting element can be provided with both excellent electron emission characteristics and excellent life characteristics.

The emission control region is preferably configured by a lattice-shaped insulating layer having a plurality of openings, and the width of the openings is preferably 2 times or more and 72 times or less the line width of the line-shaped insulating layer.

The line width of the line-shaped insulating layer is preferably 1 μm or more and 10 μm or less, and the width of the openings is preferably 40 μm or more and 80 μm or less.

The resistance layer is preferably a silicone resin layer containing silver fine particles in a dispersed state, an acrylic resin layer containing silver fine particles in a dispersed state, a polycarbonate layer containing silver fine particles in a dispersed state, or a polyester layer containing silver fine particles in a dispersed state.

The material of the insulating layer is preferably SiN, $SiO_2$, or SiON. Such an insulating layer may be formed using a photolithography method, sputtering, or a CVD method, and the line width or size of the insulating layer can be made smaller.

The lower electrode is preferably a metallic substrate or a conductive material layer, and the conductive material layer is preferably arranged on a glass substrate, on a resin substrate, or on a ceramic substrate.

The metallic substrate, the glass substrate, the resin substrate, or the ceramic substrate preferably has a roughened surface, and the roughened surface preferably has an arithmetic mean roughness Ra of 0.05 μm or more and 0.3 μm or less. As a result of such unevenness, electron emission points are more easily formed, and the electron emission characteristics of the electron emitting element can be improved.

The surface electrode is preferably a single-layer electrode composed of an Au layer, a single-layer electrode composed of a Pt layer, or a laminated electrode composed of an Au layer and a Pt layer. As a result, the electron emitting element is provided with excellent electron emission characteristics and excellent life characteristics.

Hereinafter, the present invention will be described in more detail with reference to a plurality of embodiments. The configurations shown in the drawings and in the following description are examples. The scope of the present invention is not limited to that shown in the drawings and in the following description.

First Embodiment

Figure 2:
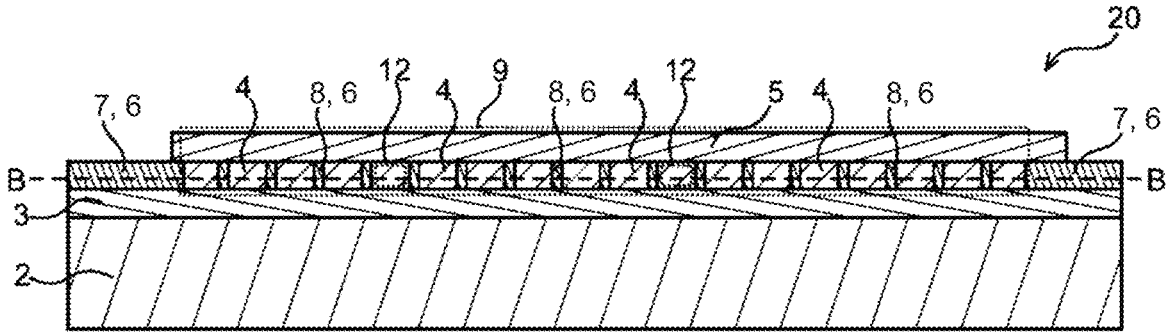
FIG. 2 is a schematic cross-sectional view of the electron emitting element taken along the broken line A-A in FIG. 1.
Figure 3:
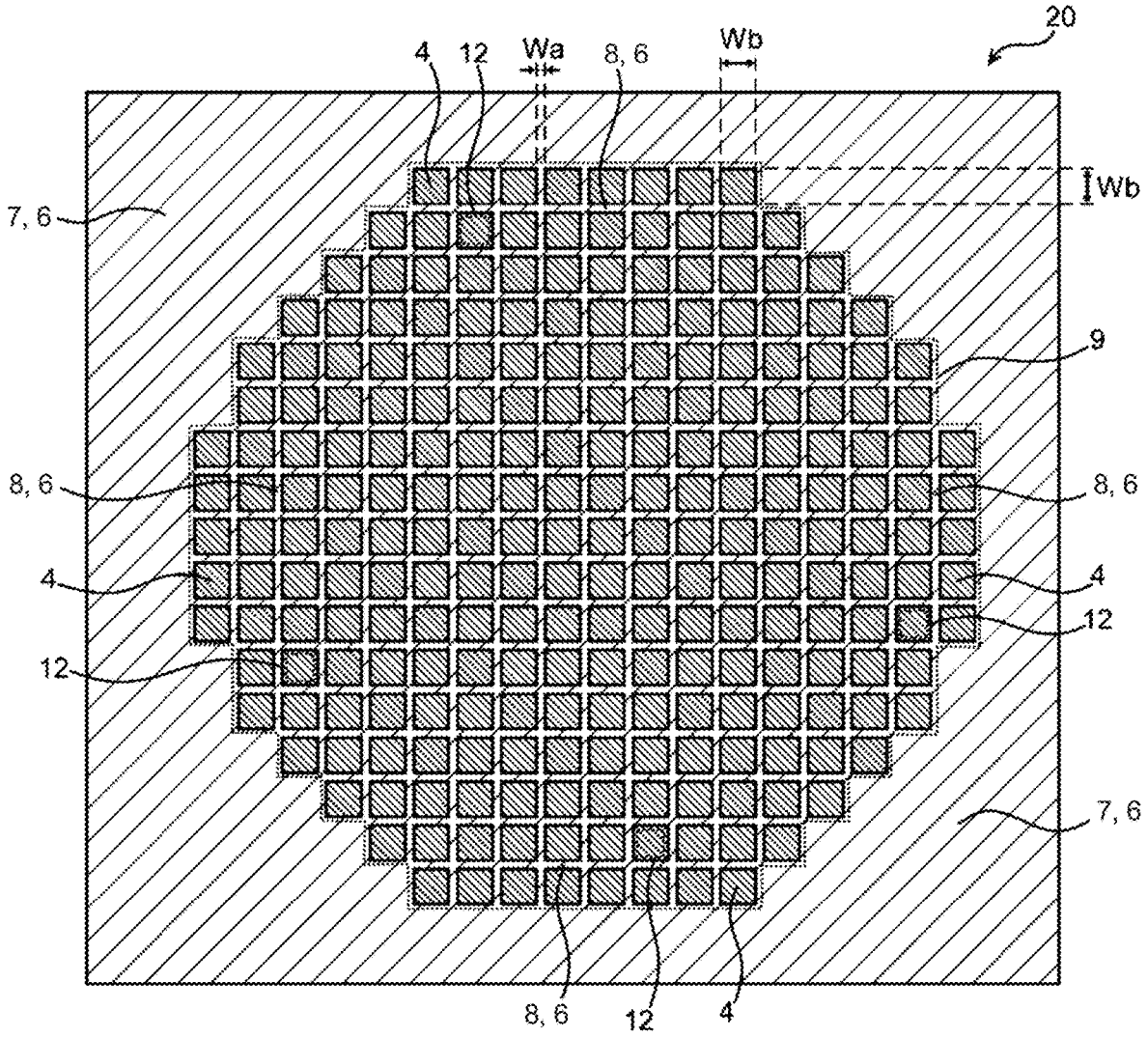
FIG. 3 is a schematic cross-sectional view of the electron emitting element taken along the broken line B-B in FIG. 2.

FIG. 1 is a plan view of an electron emitting element according to the present embodiment. FIG. 2 is a schematic cross-sectional view of the electron emitting element taken along the broken line A-A in FIG. 1. FIG. 3 is a schematic cross-sectional view of the electron emitting element taken along the broken line B-B in FIG. 2.

The electron emitting element 20 of the present embodiment includes a lower electrode 3, a surface electrode 5 facing the lower electrode 3, a resistance layer 4 arranged between the lower electrode 3 and the surface electrode 5, and an insulating layer 6 arranged between the lower electrode 3 and the surface electrode 5. The resistance layer 4 is an insulating resin layer containing conductive fine particles in a dispersed state. The lower electrode 3, the resistance layer 4, and the surface electrode 5 are provided such that electrons flow to the resistance layer 4 as a result of a potential difference being generated between the lower electrode 3 and the surface electrode 5, to cause electrons to be emitted from an electron emission region 9 of the surface electrode 5. The insulating layer 6 has a peripheral region 7 for defining the electron emission region 9, and an emission control region 8 which is arranged so as to overlap the electron emission region 9 defined by the peripheral region 7. The emission control region 8 is configured by a line-shaped insulating layer 6, or is configured by a plurality of dot-shaped insulating layers 6, or is configured by both a line-shaped insulating layer 6 and a plurality of dot-shaped insulating layers 6. The percentage of an area that the emission control region 8 represents within the area of the electron emission region 9 defined by the peripheral region 7 is 2% or more and 60% or less.

The electron emitting element 20 is an element that emits electrons from the electron emission region 9 of the surface electrode 5 into air, a gas, or a reduced pressure atmosphere or the like. The electrons emitted from the electron emission region 9 charge the gas in the air, gas or reduced pressure atmosphere or the like to generate anions. The electron emitting element 20 may be used in ion generators, ion mobility analyzers, cell stimulators, charging devices that negatively charge a target object, electron beam curing devices that cure a curing target, blowers, cooling devices, self-luminous devices that emit light from a light emitting body, and the like.

The lower electrode 3 is an electrode located below the resistance layer 4. The lower electrode 3 may be a metallic substrate, and may be a conductive material layer (such as a metallic layer or a conductor layer) provided on the substrate 2.

When the lower electrode 3 is composed of a metallic substrate, the lower electrode 3 is, for example, an aluminum plate, a stainless steel plate, a nickel plate, or the like. The thickness of the lower electrode 3 is, for example, 200 μm or more and 2 mm or less.

When the lower electrode 3 is a conductive material layer and is provided on the substrate 2, the substrate 2 is, for example, a glass substrate, a resin substrate, or a ceramic substrate. The thickness of the substrate 2 is, for example, 200 μm or more and 2 mm or less.

The metallic substrate serving as the lower electrode 3, or the glass substrate, resin substrate, or ceramic substrate serving as the substrate 2 may have a roughened surface. The roughened surface may have an arithmetic mean roughness Ra of 0.05 μm or more and 0.3 μm or less. When the lower electrode 3 is a conductive material layer, the conductive material layer is provided on the roughened surface. As a result, the lower electrode 3 can be provided with a surface having unevenness on the resistance layer side. This enables electrons to flow more easily from the lower electrode 3 toward the surface electrode 5, and the electron emission characteristics of the electron emitting element 20 can be improved. The roughened surface may be formed, for example, by subjecting the substrate surface to a shot blast treatment.

When the lower electrode 3 is a conductive material layer, the lower electrode 3 may be formed on the substrate 2 by, for example, a sputtering method, a vapor deposition method, plating, or a CVD method. The lower electrode 3 may be a single-layer electrode or a laminated electrode. The lower electrode 3 may include, for example, an aluminum layer, a gold layer, or a copper layer. Furthermore, the lower electrode 3 may be a MoN/Al/MoN laminated electrode. The thickness of the lower electrode 3 is, for example, 200 nm or more and 1 μm or less.

The resistance layer 4 is provided on the lower electrode 3. The resistance layer 4 is a layer through which a current flows due to an electric field formed by a potential difference between the surface electrode 5 and the lower electrode 3. The resistance layer 4 is an insulating resin layer containing conductive fine particles in a dispersed state.

The conductive fine particles contained in the resistance layer 4 are, for example, silver fine particles. The insulating resin contained in the resistance layer 4 is, for example, a silicone resin, an acrylic resin, a polycarbonate, or a polyester. The conductive fine particles are dispersed in the insulating resin, but some of the conductive fine particles may be aggregated.

The thickness of the resistance layer 4 may be, for example, 0.5 μm or more and 1.25 μm or less. As a result, a relatively low voltage can be applied between the lower electrode 3 and the surface electrode 5 to emit electrons from the electron emitting element 20, and the life characteristics of the electron emitting element 20 can be improved.

When the resistance layer 4 is a silicone resin layer containing silver fine particles in a dispersed state, the resistance layer 4 can be formed by, for example, applying a silicone resin coating agent containing silver fine particles in a dispersed state onto the lower electrode 3 and the insulating layer 6 (for example, by spin coating), and then curing the coating agent. For example, a coating agent containing a methyl silicone resin may be used to form the silicone resin layer. Furthermore, the silicone resin layer formed on the insulating layer 6 can be removed. As a result, the thickness of the resistance layer 4 can be made substantially the same as the thickness of the insulating layer 6.

The surface electrode 5 is an electrode located on the surface of the electron emitting element 20, and is arranged on the resistance layer 4 and on the insulating layer 6. The surface electrode 5 is, for example, a single-layer electrode composed of an Au layer, a single-layer electrode composed of a Pt layer, or a laminated electrode composed of an Au layer and a Pt layer.

The surface electrode 5 may have a thickness of 10 nm or more and 100 nm or less. The surface electrode 5 may have a plurality of openings or gaps or the like. The electrons flowing through the resistance layer 4 are capable of passing through these openings or gaps, and the electrons can be emitted from the electron emission region of the surface electrode 5. Such openings and gaps can be formed by applying a voltage between the lower electrode 3 and the surface electrode 5 (forming process, initial voltage application).

The insulating layer 6 is a layer composed of an insulator which is provided on the lower electrode 3 or on the substrate 2. For example, when the lower electrode 3 is an aluminum substrate, the insulating layer 6 may be an oxide film of the aluminum substrate. For example, when the lower electrode 3 is provided on the substrate 2, the insulating layer 6 may be a silicon nitride layer (SiN layer), a silicon oxide layer ($SiO_2$ layer), a silicon oxynitride film (SiON film), an aluminum oxide layer ($Al_2O_3$ layer), or the like. The thickness of the insulating layer 6 is, for example, 0.5 μm or more and 2 μm or less. The insulating layer 6 may be formed using, for example, a photolithography method, sputtering, or a CVD method.

The insulating layer 6 has a peripheral region 7 and an emission control region 8.

The peripheral region 7 is a region for defining the electron emission region 9. In the electron emission region 9, electrons flow through the resistance layer 4 from the lower electrode 3 toward the surface electrode 5 as a result of an electric field being generated between the lower electrode 3 and the surface electrode 5, and is a region in which electrons are emitted from the surface electrode 5 to the outside.

The peripheral region 7 (not including the emission control region 8) has an opening which serves as the electron emission region 9. The resistance layer 4 can be provided inside this opening. As a result, current can be made to flow only through the region of the resistance layer 4 that overlaps the opening of the peripheral region 7, and electrons can be emitted from the region of the surface electrode 5 that overlaps the opening of the peripheral region 7. Therefore, the electron emission region 9 can be defined by the opening of the peripheral region 7. The opening of the peripheral region 7 (not including the emission control region 8) may have a circular shape or a square shape.

The size of the opening of the peripheral region 7 that defines the electron emission region 9 (the size of the electron emission region 9) may be 1 mm or more and 50 mm or less. For example, when the opening of the peripheral region 7 that defines the electron emission region 9 has a circular shape, the diameter of the opening may be 1 mm or more and 50 mm or less. When the opening has a square shape, the length of one side of the opening may be, for example, 1 mm or more and 50 mm or less.

The emission control region 8 of the insulating layer 6 is a region for controlling the electron emission of the electron emitting element 20. The emission control region 8 is arranged so as to overlap the electron emission region 9 defined by the peripheral region 7 of the insulating layer 6. The emission control region 8 may be connected to or separated from the peripheral region 7.

The emission control region 8 is configured by a line-shaped insulating layer 6, or is configured by a plurality of dot-shaped insulating layers 6, or is configured by both a line-shaped insulating layer 6 and dot-shaped insulating layers 6. The edges of the line-shaped insulating layer 6 and the edges of the dot-shaped insulating layers 6 make contact with the resistance layer 4, and serve as an interface between the insulating layer 6 and the resistance layer 4. The conductive fine particles in the resistance layer 4 have a tendency to accumulate at the edges of such an insulating layer 6 (the interface between the resistance layer 4 and the insulating layer 6). As a result, electrons easily flow from the lower electrode 3 toward the surface electrode 5 at the locations where the conductive fine particles have accumulated (at the sections near the interface with the resistance layer 4). Consequently, a large number of electron emission points are formed near the edges of the insulating layer 6. Therefore, by evenly distributing such an emission control region 8 in the electron emission region 9 defined by the peripheral region 7, electron emission points can be evenly formed in the electron emission region 9, and the electron emission characteristics of the electron emitting element 20 can be improved.

The percentage of the area that the emission control region 8 represents within the area of the electron emission region 9 defined by the peripheral region 7 is 2% or more and 60% or less. As a result, a decrease in the number of electrons flowing from the lower electrode 3 toward the surface electrode 5 can be suppressed. Further, a decrease in the electron emission amount of the electron emitting element 20 can be suppressed.

The total edge length of the emission control region 8 within a unit area of the electron emission region 9 defined by the peripheral region 7 is 90 $cm/cm^2$ or more and 5,000 $cm/cm^2$ or less. Consequently, a large number of electron emission points can be formed in the electron emission region 9, and the electron emission characteristics of the electron emitting element 20 can be improved. Furthermore, excessive accumulation of the conductive fine particles in the resistance layer 4 can be suppressed. Also, it is possible to suppress the formation of agglomerates of the conductive fine particles, which become leakage paths between the lower electrode 3 and the surface electrode 5. As a result, sudden interruptions in the function of the electron emitting element 20 and a reduction in the life characteristics can be suppressed. Therefore, the life characteristics of the electron emitting element 20 can be improved. Moreover, a decrease in the life characteristics can be suppressed even when the electron emission amount is increased.

The line width Wa of the line-shaped insulating layer 6 constituting the emission control region 8 may be 1 μm or more and 10 μm or less, and is preferably 3 μm or more and 8 μm or less. As a result, the length of the edges of the emission control region 8 can be made longer, and a large number of electron emission points can be formed in the electron emission region 9. Furthermore, it is possible to prevent the emission control region 8 from obstructing the flow of electrons between the lower electrode 3 and the surface electrode 5, and a decrease in the electron emission amount of the electron emitting element 20 can be suppressed.

The overall shape of the insulating layer 6 constituting the emission control region 8 is not particularly limited, and is, for example, a lattice pattern, a concentric circle, a spiral shape, a comb shape, a cross pattern, a dot pattern, a stripe pattern, or a wave pattern. In the electron emitting element 20 shown in FIG. 1 to 3, the insulating layer 6 constituting the emission control region 8 has a lattice pattern. As a result of the emission control region 8 having a lattice pattern, the length of the edges of the emission control region can be made longer.

In the electron emission region 9, a large number of rectangular openings 12 are aligned and formed in the insulating layer 6, and the resistance layer 4 is provided inside these openings 12. This enables the emission control region 8 having a lattice pattern to be formed. The line width Wa of the line-shaped insulating layer 6 that separates two adjacent openings 12 may be, for example, 1 μm or more and 10 μm or less, and is preferably 3 μm or more and 8 μm or less. The openings 12 may, for example, be a square shape, but may also be a rectangular shape. The width Wb of the openings 12 may be, for example, 2 times or more and 72 times or less the line width of the insulating layer 6, and is preferably 8 or more and 16 or less. Furthermore, the width Wb of the openings 12 may be, for example, 10 μm or more and 360 μm or less, and is preferably 40 μm or more and 80 μm or less.

The periphery of the openings 12 serve as the edges of the insulating layer 6 constituting the emission control region 8. Therefore, the value (opening 12 width Wb×4×number of openings 12) gives the total edge length of the insulating layer 6 constituting the emission control region 8.

The total area of the openings 12 is the total opening area, and the value (area of electron emission region 9)−(total opening area) is the area of the emission control region 8. Further, the percentage of the area that the emission control region 8 represents within the area of the electron emission region 9 can be calculated by (area of emission control region 8)/(area of electron emission region 9)×100. The percentage of the area that the emission control region 8 represents within the area of the electron emission region 9 may be 2% or more and 60% or less (total opening area percentage of 40% or more and 98% or less), is preferably 2.8% or more and 55.7% or less (total opening area percentage of 44.3% or more and 97.2% or less), and is more preferably 10% or more and 30% or less (total opening area percentage of 70% or more and 90% or less).

Second Embodiment

Figure 4:
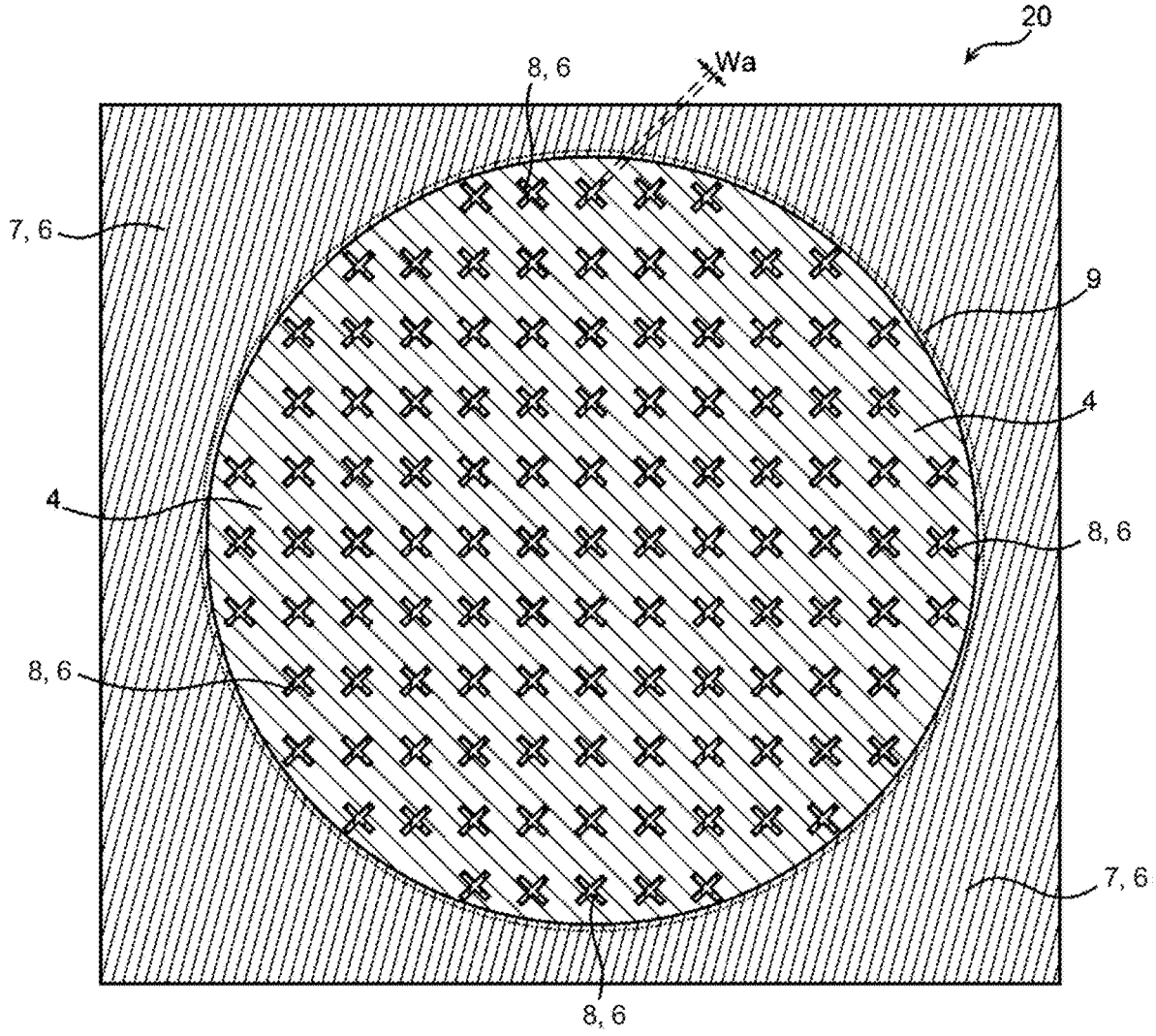
FIG. 4 is a schematic cross-sectional view of an electron emitting element according to an embodiment of the present invention.

In the second embodiment, the overall shape of the insulating layer 6 constituting the emission control region 8 is a cross pattern. FIG. 4 is a schematic cross-sectional view of an electron emitting element according to the second embodiment. This cross-sectional view corresponds to the cross-sectional view shown in FIG. 3 of the first embodiment.

The emission control region 8 can have a pattern in which cross-shaped insulating layers 6 are evenly distributed in the electron emission region 9. In this way, by making the overall shape of the emission control region 8 a cross pattern, the overall length of the edges of the emission control region 8 can be made longer. Therefore, a large number of electron emission points can be formed in the electron emission region 9.

Furthermore, the overall shape of the emission control region 8 may be a shape that combines a lattice pattern as in the first embodiment and the cross pattern of the second embodiment.

The other configurations are the same as that of the first embodiment. Moreover, as long as there is no contradiction, the description of the first embodiment also applies to the second embodiment.

Third Embodiment

Figure 5:
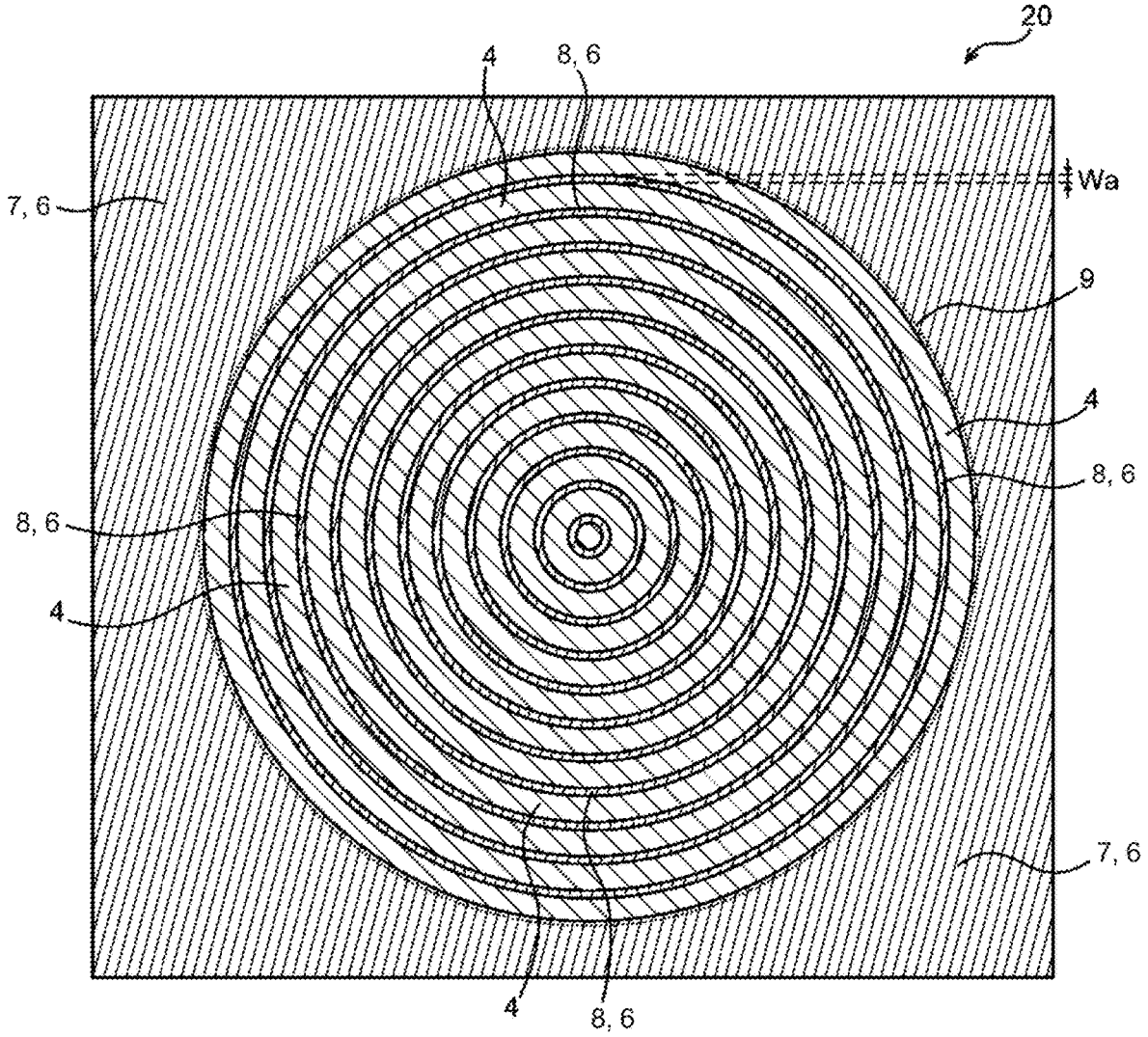
FIG. 5 is a schematic cross-sectional view of an electron emitting element according to an embodiment of the present invention.

In the third embodiment, the overall shape of the insulating layer 6 constituting the emission control region 8 is a concentric circular shape. FIG. 5 is a schematic cross-sectional view of an electron emitting element according to the third embodiment. This cross-sectional view corresponds to the cross-sectional view shown in FIG. 3 of the first embodiment.

The emission control region 8 having a concentric circular shape can be provided so that the insulating layer 6 is evenly distributed in the electron emission region 9. In this way, by making the overall shape of the emission control region 8 a concentric circular shape, the overall length of the edges of the emission control region 8 can be made longer. Therefore, a large number of electron emission points can be formed in the electron emission region 9.

Furthermore, the overall shape of the emission control region 8 may be a shape that combines a lattice pattern as in the first embodiment and the concentric circular shape of the third embodiment, or combines a cross pattern as in the second embodiment and the concentric circular shape of the third embodiment.

The other configurations are the same as that of the first embodiment. Furthermore, as long as there is no contradiction, the description of the first embodiment also applies to the third embodiment.

Fourth Embodiment

Figure 6:
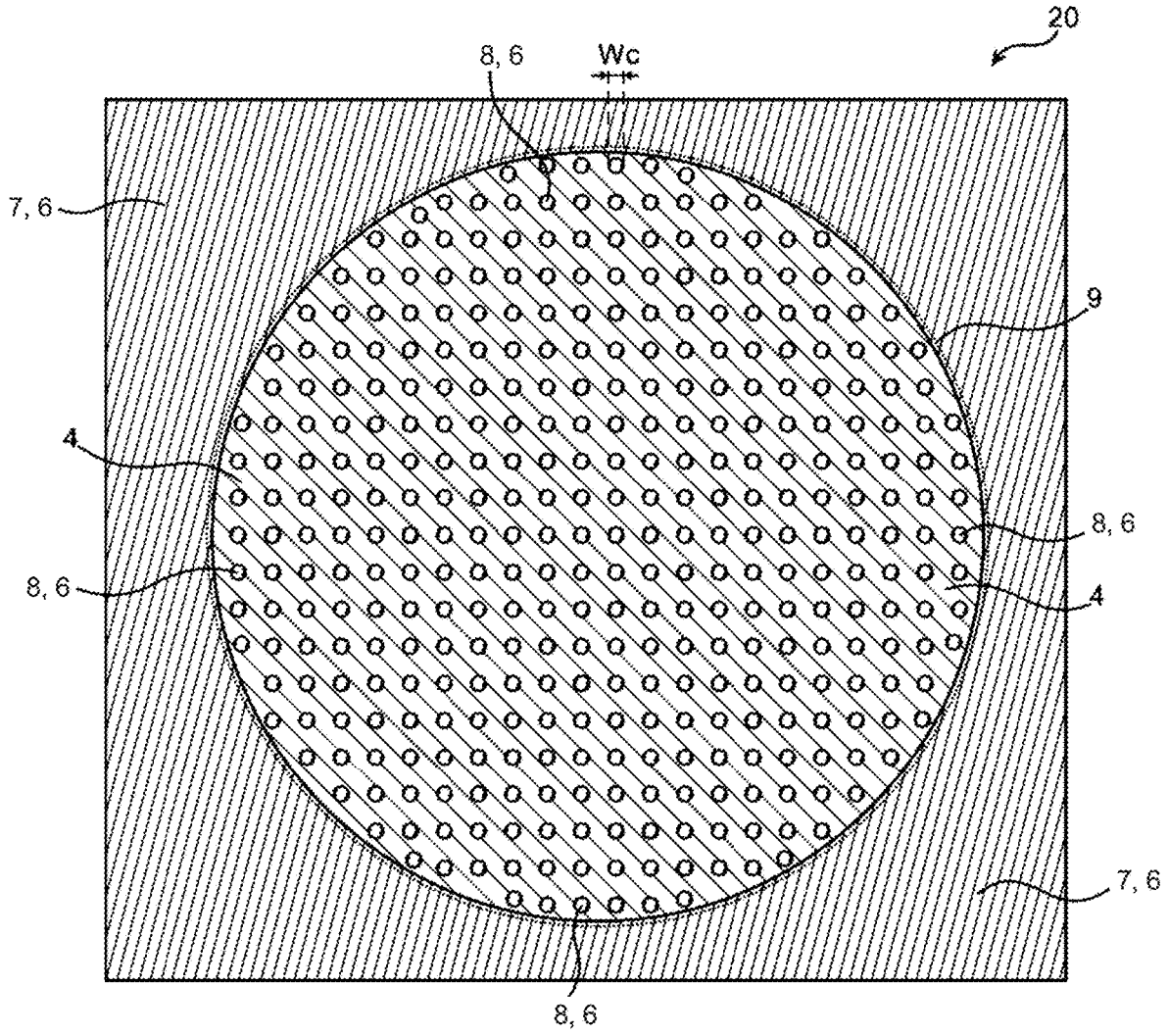
FIG. 6 is a schematic cross-sectional view of an electron emitting element according to an embodiment of the present invention.

In the fourth embodiment, the overall shape of the insulating layer 6 constituting the emission control region 8 is a dot pattern. FIG. 6 is a schematic cross-sectional view of an electron emitting element according to the fourth embodiment. This cross-sectional view corresponds to the cross-sectional view shown in FIG. 3 of the first embodiment.

The emission control region 8 can have a pattern in which dot-shaped insulating layers 6 are evenly distributed in the electron emission region 9. In FIG. 6, each dot has a circular shape. However, the shape of each dot is not particularly limited, and may be a square shape or a triangular shape. Furthermore, the plurality of dots constituting the emission control region 8 may all have the same size, or may have different sizes. In this way, by making the overall shape of the emission control region 8 a dot pattern, the overall length of the edges of the emission control region 8 can be made longer. Therefore, a large number of electron emission points can be formed in the electron emission region 9.

The size We of each dot constituting the emission control region 8 may be, for example, 1 μm or more and 10 μm or less.

Furthermore, the overall shape of the emission control region 8 may be a shape that combines a lattice pattern as in the first embodiment and the dot pattern of the fourth embodiment, or combines a cross pattern as in the second embodiment and the dot pattern of the fourth embodiment, or combines a concentric circular shape as in the third embodiment and the dot pattern of the fourth embodiment.

The other configurations are the same as that of the first embodiment. Furthermore, as long as there is no contradiction, the description of the first embodiment also applies to the fourth embodiment.

Fifth Embodiment

Figure 7:
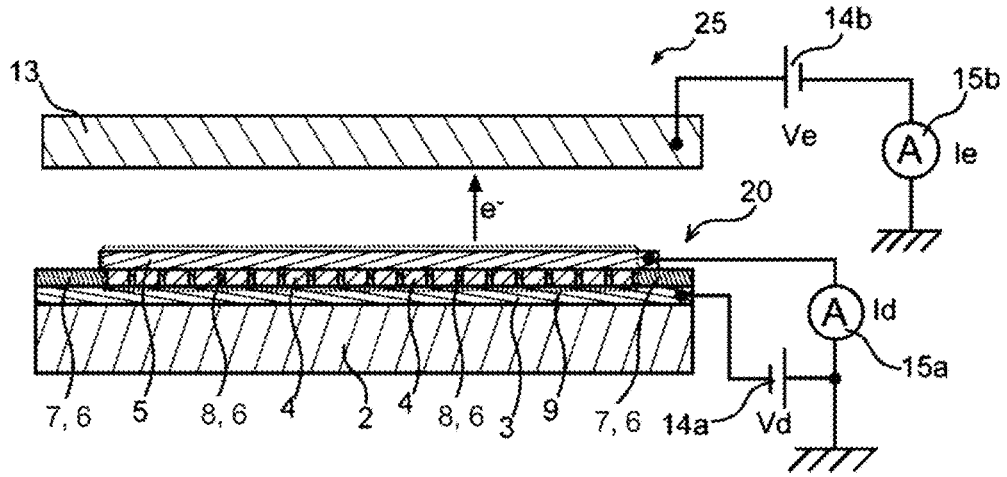
FIG. 7 is a schematic view of an electron emitting device including an electron emitting element according to an embodiment of the present invention.

FIG. 7 is a schematic cross-sectional view of an electron emitting device according to the present embodiment. FIG. 7 also displays a circuit diagram showing the electrical configuration of the electron emitting device.

The electron emitting device 25 of the present embodiment includes an electron emitting element 20, an electric field forming electrode 13, and power supplies 14*a* and 14*b*. The power supply 14*a* is provided so as to apply a voltage between the lower electrode 3 and the surface electrode 5. The power supply 14*b* is provided so as to apply a voltage between the electron emitting element 20 and the electric field forming electrode 13.

Furthermore, the electron emitting device 25 may include an ammeter 15*a* provided so as to measure a current Id flowing between the lower electrode 3 and the surface electrode 5, or an ammeter 15*b* provided so as to measure a current Ie that flows due to the electrons emitted from the electron emitting element 20 or the ions generated from these electrons reaching the electric field forming electrode 13.

The electron emitting element 20 has been described in the first to fourth embodiments, and the description will be omitted here.

The electric field forming electrode 13 is an electrode for forming an electric field between the surface electrode 5 of the electron emitting element 20 and the electric field forming electrode 13. The electric field forming electrode 13 and the power supply 14*b* are provided so as to generate an electric field that causes the electrons emitted from the surface electrode 5 or the ions generated from these electrons to move in the direction of the electric field forming electrode 13. Furthermore, the ammeter 15*b* is provided so as to measure the current Ie generated as a result of the electrons emitted from the surface electrode 5 or the ions generated from these electrons reaching the electric field forming electrode 13.

An example of the operation of the electron emitting device 25 will be described.

When a voltage is applied between the lower electrode 3 and the surface electrode 5 by the power supply 14*a*, an electric field is formed in the resistance layer 4 between the lower electrode 3 and the surface electrode 5. This electric field causes electrons of the lower electrode 3 to flow through the resistance layer 4 toward the surface electrode 5 (current Id). Then, some of the electrons that reach the surface electrode 5 pass through the openings and the like of the surface electrode 5, and are emitted to the outside of the electron emitting element 20. The electrons emitted from the surface electrode 5 move toward the electric field forming electrode 13 as a result of the electric field formed by the electric field forming electrode 13. Furthermore, the emitted electrons ionize the oxygen molecules and the like in the atmosphere to generate oxygen ions. The oxygen ions reach the electric field forming electrode 13 due to the electric field, and transfer their electric charge to the electric field forming electrode 13. As a result, the potential of the electric field forming electrode 13 changes, and the current Ie flows. The current Ie represents the amount of electrons emitted from the electron emitting element 20.

The voltage applied between the lower electrode 3 and the surface electrode 5 is preferably 25 V or less. As a result, the generation of ozone and NOx can be suppressed. Furthermore, the current flowing between the lower electrode 3 and the surface electrode 5 can be adjusted using a PWM circuit.

Electron Emission Experiment

Three electron emitting elements (Examples 1 to 3) each provided with an emission control region 8 having a lattice pattern as shown in FIG. 1 to 3 were prepared (the number of openings 12 and the like were not as shown in FIG. 1 to 3). The electron emitting elements of Examples 1 to 3 had different opening widths Wb. However, the other configurations were the same. Furthermore, an electron emission element of a comparative example, which did not include the emission control region 8 of the insulating layer 6, was also prepared. The other configurations of the electron emitting element of the comparative example were the same as those of Examples 1 to 3.

A glass substrate (20 mm×24 mm) having a thickness of 0.7 mm was used as the substrate 2. The lower electrode 3 was a laminated electrode represented as follows: MoN layer (100 nm)/Al layer (200 nm)/MoN layer (50 nm). The lower electrode 3 was formed by a sputtering method or a CVD method.

The insulating layer 6 (peripheral region 7 and emission control region 8) was a SiN layer (thickness: 1 μm). The peripheral region 7 was formed so that the diameter of the electron emission region 9 (diameter of the opening) was 16 mm. The SiN layer was formed by a CVD method. Furthermore, a photolithography method was used to form the lower electrode 3 and the pattern of the insulating layer 6.

In the electron emitting elements of Examples 1 to 3, the line width of the line-shaped insulating layer 6 constituting the emission control region 8 was 5 μm. In the electron emitting element of Example 1, the emission control region 8 having a lattice pattern was formed so that the opening width Wb of the openings 12 was 10 μm. In the electron emitting element of Example 2, the emission control region 8 having a lattice pattern was formed so that the opening width Wb of the openings 12 was 60 μm. In the electron emitting element of Example 3, the emission control region 8 having a lattice pattern was formed so that the opening width Wb of the openings 12 was 360 μm. An emission control region was not formed in the electron emitting element of the comparative example.

The resistance layer 4 (thickness: 1 μm) was formed by coating the inside of the openings of the insulating layer 6 (the inside of the openings 12 or the inside of the opening of the peripheral region 7) with a methyl silicone resin coating agent containing Ag nanoparticles having an average particle size of 10 nm in a dispersed state by using a spin coating method, and then curing the coating layer. The mass ratio of the Ag nanoparticles to the silicone solid content was approximately 1:10.

The surface electrode 5 (20 nm) was formed by sputtering gold (Au) onto the resistance layer 4 and the insulating layer 6.

The electron emitting elements prepared in Examples 1 to 3 and in the comparative example were used to form the electron emitting device 25 shown in FIG. 7. Then, a forming process was carried out with respect to the electron emitting elements of Examples 1 to 3 and the Comparative Example. Furthermore, the current Ie generated due to the emission of electrons from the electron emitting element during the forming process was measured. The forming process was performed in a room temperature environment (R/R environment, temperature 20° C. to 25° C., relative humidity 25% to 45%).

In the forming process, the voltage Vd applied between the lower electrode 3 and the surface electrode 5 was changed from 0 V to 25 V at a voltage ramp rate of 0.1 V/sec, and the voltage Vd was set to 0 V after reaching 25 V.

The opening width Wb, the emission area (area of the resistance layer 4, total area of the openings 12), the proportion of the emission area in the electron emission region 9, the proportion of the emission control region 8 in the electron emission region 9, and the total edge length of the emission control region 8 per unit area are shown in Table 1 for the electron emitting elements prepared in Examples 1 to 3 and in the comparative example. In Examples 1 to 3, the emission area is the total area of the openings 12 in the electron emission region 9. In the comparative example, it is the area of the electron emission region 9.

TABLE 1

| | Opening width Wb | Emission area (Area of resistance layer) | Proportion of emission area | Proportion of emission control region | Edge length of emission control region |
|---|---|---|---|---|---|
| Example 1 | 10 μm | 0.89 $cm^2$ | 44.4% | 55.6% | 1,774 $cm/cm^2$ |
| Example 2 | 60 μm | 1.71 $cm^2$ | 83.2% | 16.8% | 554 $cm/cm^2$ |
| Example 3 | 360 μm | 1.95 $cm^2$ | 87.6% | 12.4% | 97 $cm/cm^2$ |
| Comparative example | None | 2.01 $cm^2$ | 100% | 0% | None |

Figure 8:
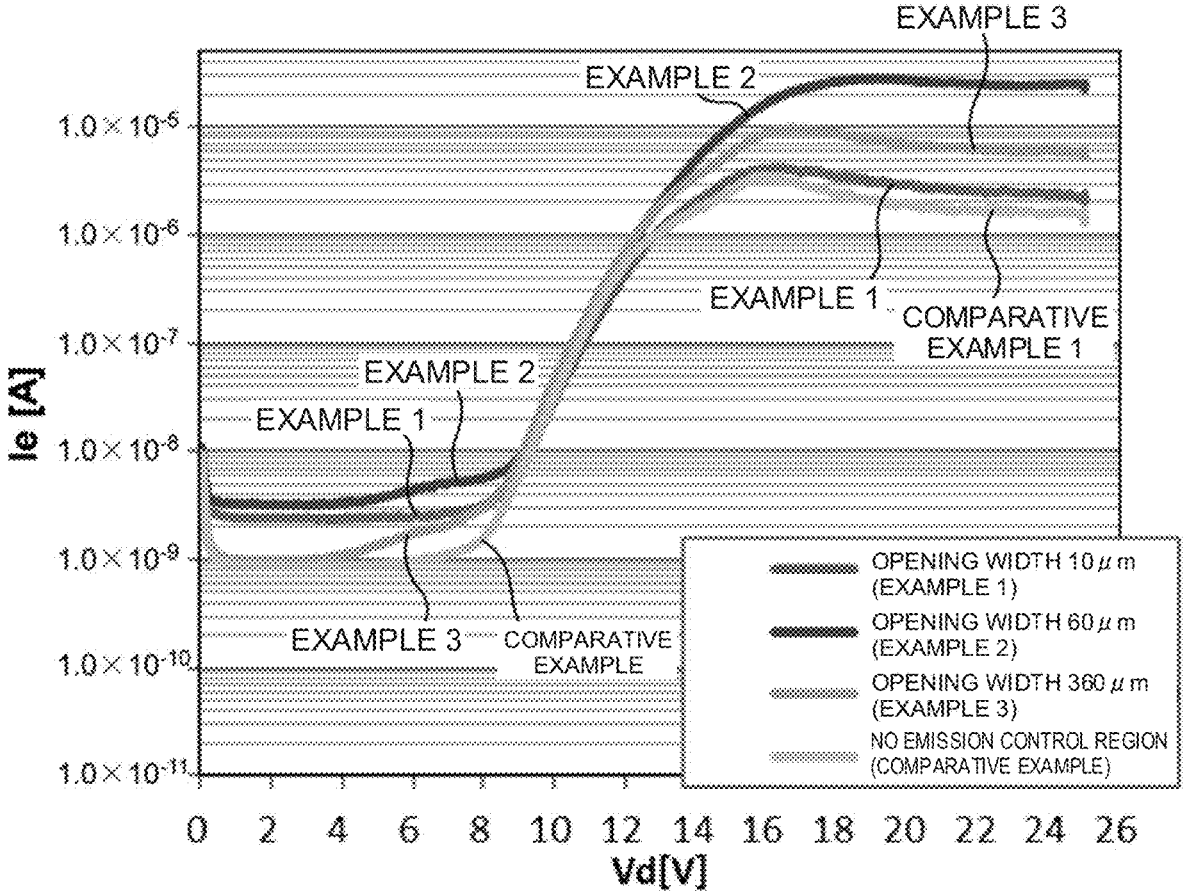
FIG. 8 is a graph showing the measurement results of an electron emission experiment.
Figure 9A:
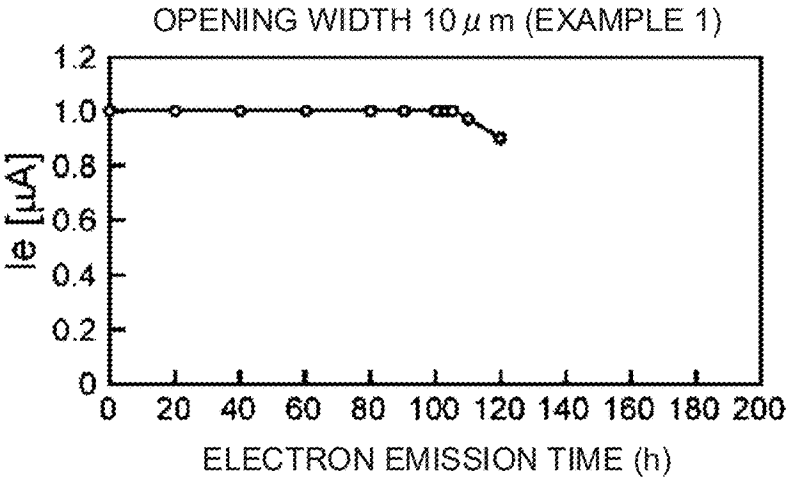
FIGS. 9A to 9D are graphs showing the measurement results of an aging experiment.
Figure 9B:
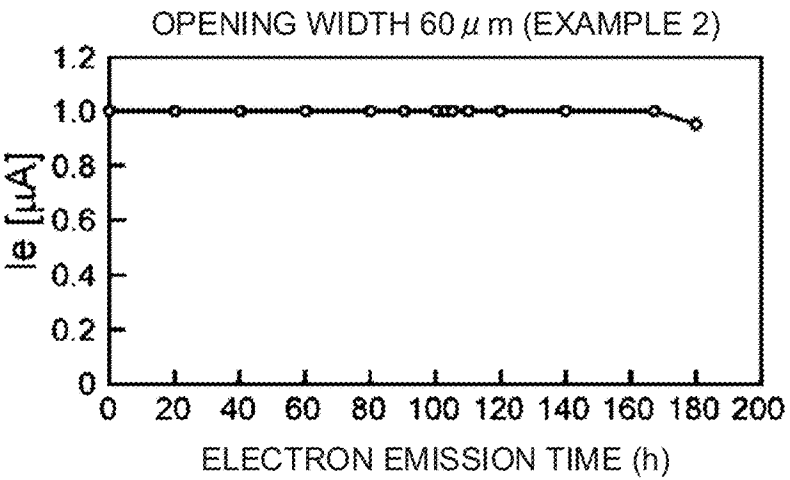
Figure 9C:
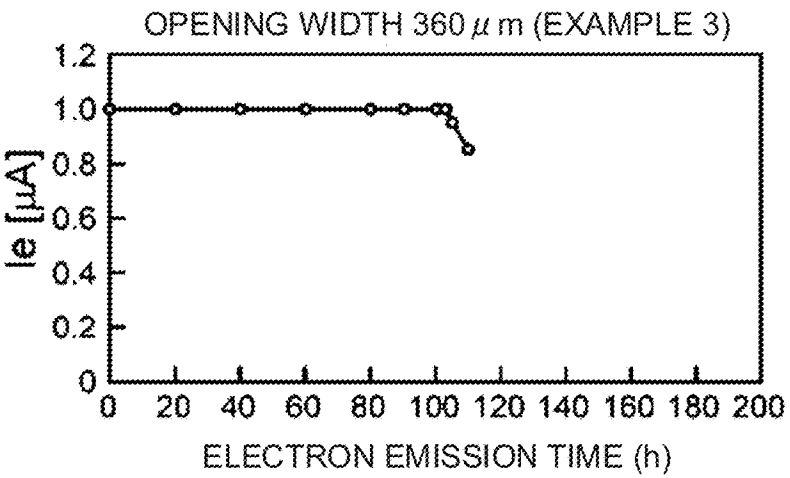
Figure 9D:
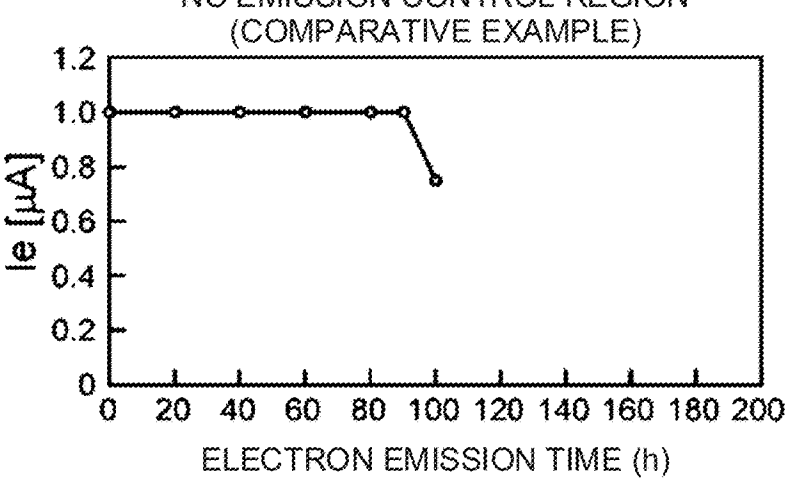
Figure 10A:
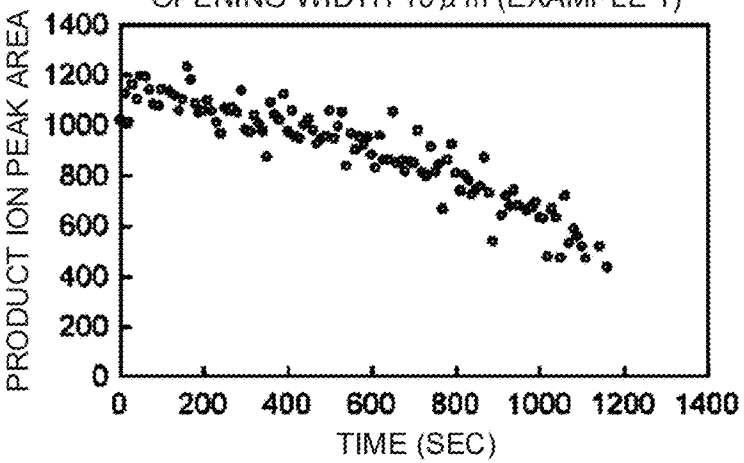
FIGS. 10A to 10D are graphs showing changes in the product ion peak area measured by an ion mobility analyzer incorporating the prepared electron emitting elements.
Figure 10B:
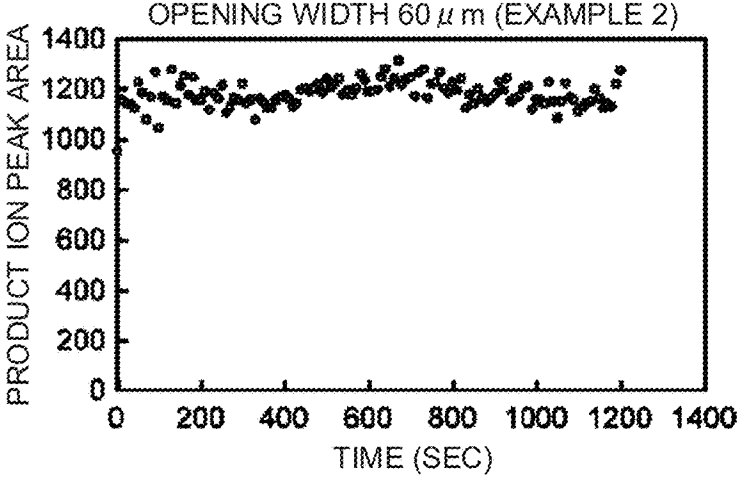
Figure 10C:
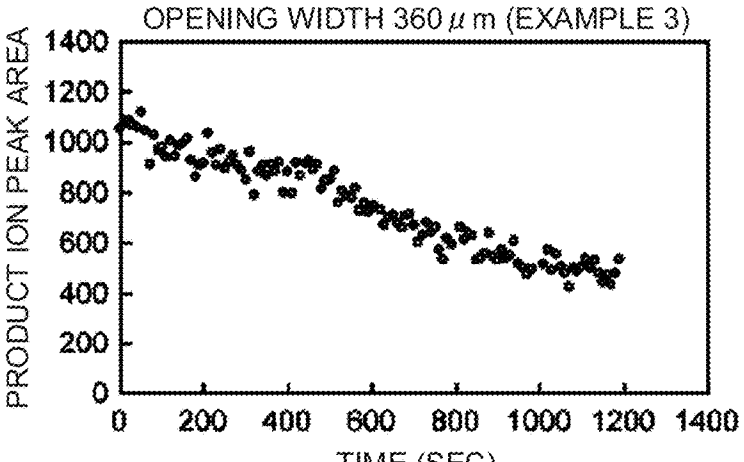
Figure 10D:
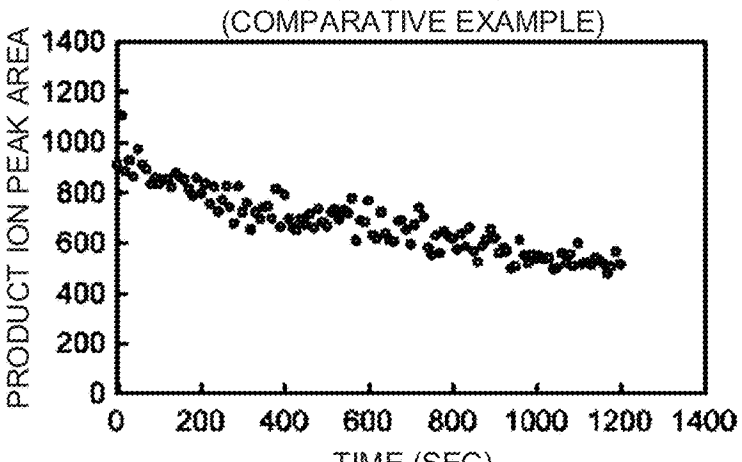

A graph showing the change in the current Ie during the forming process performed with respect to the electron emitting elements of Examples 1 to 3 and the comparative example is shown in FIG. 8.

In the electron emitting elements of Examples 1 to 3, a larger current Ie was measured when compared to the electron emitting element of the comparative example. Therefore, it was confirmed that the electron emission amount can be increased by providing the emission control region 8.

Furthermore, the electron emission amount (current Ie) of the element of Example 2 was larger than that of the elements of Examples 1 and 3. In the element of Example 2, the proportion of the emission area is large, and the total edge length of the emission control region is large. This is thought to have led to the formation of a large number of electron emission points in the electron emission region 9 and an increase in the electron emission amount.

Next, an aging experiment was conducted in which the elements of Examples 1 to 3 and the comparative example were driven for a long time. In the aging experiment, the voltage Vd applied between the lower electrode 3 and the surface electrode 5 was changed so that the current Ie generated due to the emission of electrons from the electron emitting element reached a target value of 1.0 μA. Furthermore, the current flowing between the lower electrode 3 and the surface electrode 5 was adjusted using a PWM circuit (duty ratio: fixed at 50%). The aging experiment was performed in a room temperature environment (R/R environment, temperature 20° C. to 25° C., relative humidity 25% to 45%).

The results of the aging experiment performed with respect to the elements of Examples 1 to 3 and the comparative example are shown in FIGS. 9A to 9D and Table 2. The electron emission time of the element of the comparative example was 90 hours. However, the electron emission times of the elements of Examples 1 to 3 exceeded 100 hours. In particular, the electron emission time of the element of Example 2 exceeded 160 hours. This is thought to be because, in the element of Example 2, a large number of electron emission points were formed in the electron emission region 9.

From these results, it was found that the element of Example 2 was capable of suppressing a reduction in the life characteristics, even when the electron emission amount was increased.

TABLE 2

| | Electron emission characteristics | Electron emission time | IMS characteristics | Overall evaluation |
|---|---|---|---|---|
| Example 1 | Good | 105 hours | Good | Good |
| Example 2 | Excellent | 167 hours | Excellent | Excellent |
| Example 3 | Good | 103 hours | Good | Good |
| Comparative example | Average | 90 hours | Average | Average |

Ion Mobility Spectrometry (IMS)

The electron emitting elements prepared in Examples 1 to 3 and the comparative example were incorporated into a drift tube-type ion mobility analyzer (see Japanese Unexamined Patent Application Publication No. 2019-186190), and the change in the product ion peak area was measured. Dry air was flowed through the ion mobility analyzer as a drift gas, and electrons were emitted from the incorporated electron emitting element to ionize the components of the dry air. Then, the generated ions were introduced into a drift part using a gate, and the ions separated in the drift part were detected by a detector to obtain a product ion peak. The voltage Vd applied between the lower electrode 3 and the surface electrode 5 was set to 17 V. The ion detection described above was consecutively performed for 1,200 seconds.

The measurement results are shown in FIGS. 10A to 10D. Furthermore, Table 2 shows the evaluation of the IMS characteristics and the overall evaluation of each element.

In the experiment using the element of the comparative example, the peak area gradually decreased from about 900 to 500 over time. Moreover, in the experiments using the elements of Example 1 and 3, the peak area gradually decreased from about 1,100 over time. In addition, in the experiment using the element of Example 2, the peak area was stable at about 1,200 over the entire measurement time. Consequently, it was found that stable measurement results can be obtained when the element of Example 2 was used in the ion mobility analyzer.

What is claimed is:

1. An electron emitting element including:

a lower electrode;

a surface electrode facing the lower electrode;

a resistance layer arranged between the lower electrode and the surface electrode; and an insulating layer arranged between the lower electrode and the surface electrode; wherein the resistance layer is an insulating resin layer containing conductive fine particles in a dispersed state, the lower electrode, the resistance layer, and the surface electrode are provided such that electrons flow to the resistance layer as a result of a potential difference being generated between the lower electrode and the surface electrode, to cause electrons to be emitted from an electron emission region of the surface electrode, the insulating layer has a peripheral region for defining the electron emission region, and an emission control region which is arranged so as to overlap the electron emission region defined by the peripheral region, the emission control region is configured by a line-shaped insulating layer, or is configured by a plurality of dot-shaped insulating layers, or is configured by both a line-shaped insulating layer and a plurality of dot-shaped insulating layers, and a percentage of an area that the emission control region represents within an area of an electron emission region defined by the peripheral region is 2% or more and 60% or less.

2. The electron emitting element according to claim 1, wherein a total edge length of the emission control region within a unit area of the electron emission region defined by the peripheral region is 90 cm/cm$^2$ or more and 5,000 cm/cm$^2$ or less.

3. The electron emitting element according to claim 1, wherein a line width of the line-shaped insulating layer or a size of the dot-shaped insulating layer is 1 μm or more and 10 μm or less.

4. The electron emitting element according to claim 1, wherein the emission control region is evenly distributed in the electron emission region defined by the peripheral region.

5. The electron emitting element according to claim 1, wherein the emission control region is configured by a lattice-shaped insulating layer having a plurality of openings, and a width of the openings is 2 times or more and 72 times or less a line width of the line-shaped insulating layer.

6. The electron emitting element according to claim 5, wherein a line width of the line-shaped insulating layer is 1 μm or more and 10 μm or less, and a width of the openings is 40 μm or more and 80 μm or less.

7. The electron emitting element according to claim 1, wherein the resistance layer is a silicone resin layer containing silver fine particles in a dispersed state, an acrylic resin layer containing silver fine particles in a dispersed state, a polycarbonate layer containing silver fine particles in a dispersed state, or a polyester layer containing silver fine particles in a dispersed state.

8. The electron emitting element according to claim 1, wherein a material of the insulating layer is SiN, $SiO_2$, or SiON.

9. The electron emitting element according to claim 1, wherein the lower electrode is a metallic substrate or a conductive material layer, and the conductive material layer is arranged on a glass substrate, on a resin substrate, or on a ceramic substrate.

10. The electron emitting element according to claim 9, wherein the metallic substrate, the glass substrate, the resin substrate, or the ceramic substrate has a roughened surface, and the roughened surface has an arithmetic mean roughness Ra of 0.05 μm or more and 0.3 μm or less.

11. The electron emitting element according to claim 1, wherein the surface electrode is a single-layer electrode composed of an Au layer, a single-layer electrode composed of a Pt layer, or a laminated electrode composed of an Au layer and a Pt layer.

* * * * *